US008479342B2

(12) United States Patent
Benson et al.

(10) Patent No.: US 8,479,342 B2
(45) Date of Patent: Jul. 9, 2013

(54) APPARATUS FOR CLEANING EXERCISE MATS

(76) Inventors: Mindy Benson, Austin, TX (US); Nathan Benson, Austin, TX (US)

( * ) Notice: Subject to any disclaimer, the term of this patent is extended or adjusted under 35 U.S.C. 154(b) by 0 days.

(21) Appl. No.: 13/168,321

(22) Filed: Jun. 24, 2011

(65) Prior Publication Data

US 2012/0325267 A1 Dec. 27, 2012

(51) Int. Cl.
*B08B 11/00* (2006.01)

(52) U.S. Cl.
USPC .... 15/40; 15/77; 15/88.3; 15/102; 134/122 R

(58) Field of Classification Search
USPC ..... 15/40, 77, 88.3, 102; 134/122 R
See application file for complete search history.

(56) References Cited

U.S. PATENT DOCUMENTS 1,183,672 A 5/1916 Ritchey
1,930,575 A 10/1933 Wynd et al.
2,232,805 A * 2/1941 Ruedebush ..... 69/37
3,396,422 A 8/1968 Haverberg
4,104,755 A * 8/1978 Smith ..... 15/40
4,926,520 A 5/1990 Watson
5,072,478 A 12/1991 Wagner et al.

OTHER PUBLICATIONS http://www.j-kocompany.com/products.php?product_id=1.
http://matsana.net/.
http://www.alibaba.com/product-tp/114626971/WELL.html.
http://www.alibaba.com/product-tp/105405056/Car_mat_cleaner_KM_300A.html.

* cited by examiner

*Primary Examiner* — Randall Chin
(74) *Attorney, Agent, or Firm* — TechLaw LLP; Jonathan Kidney; Mark Huebscher

(57) ABSTRACT

An apparatus for cleaning rubberized, plastic, or foam exercise mats is disclosed. The apparatus includes a machine having a frame structure, at least two sets of rollers, a mechanism coupled to the rollers to push and/or pull the mat through the machine, a cleaning solution application system, a scrubbing system, a cleaning solution removal system, and a housing to enclose the machine.

18 Claims, 5 Drawing Sheets

APPARATUS FOR CLEANING EXERCISE MATS

FIELD OF THE INVENTION

The present invention relates to a machine that cleans both sides of thin, flexible, and uncarpeted floor mats, including exercise mats such as those used for yoga, pilates, barre, or other similar exercise routines.

BACKGROUND

Participation in fitness activities continues to grow in ever increasing rates. Amongst the largest growth sectors in fitness are yoga, pilates, and barre. Participation in yoga alone has increased at a rate of about 20% per year since 2006 according to the National Sporting Goods Association, or an estimated 20 million Americans. Though some people practice these exercise routines in their own home, many individuals seek out a workout center or studio for instructional purposes.

As part of these exercise routines, participants use a thin, flexible mat to place between themselves and the floor. The mat is typically six (6) feet long by two (2) feet wide and is made from a special plastic-based foam or sometimes rubber. These materials create friction to facilitate the user in performing various moves and exercises. Often, these mats are provided to participants as a courtesy by a gym, workout center, or exercise studio. Many participants decide to purchase their own mat simply because they find another person's sweat unappealing.

These exercise routines are strenuous and cause the body to sweat. This sweat is transferred to the mat during the workout. Sweat contains germs, bacteria, and human bodily wastes. Sometimes, the sweat accumulates so greatly that the user must turn the mat over during the exercise routine because the mat becomes slippery. This exposes the sweaty side of the mat to the floor which causes the mat to pick up additional debris such as dirt, dust, hair, and other detritus not to mention germs and bacteria. As a result, patrons insist that the mats are cleaned and sanitized prior to their use, for fear of becoming ill.

Gyms, workout centers, or exercise studios have classes scheduled throughout the day with minimal intermission time in order to maximize revenue. In order to provide cleaned and sanitized mats to patrons, the need for a machine that performs this function quickly becomes very important.

Many of the disclosed apparatuses teach cleaning substantially flat articles that are non-flexible. For example, U.S. Pat. No. 1,183,672, granted to Ritchey et al., discloses a machine for cleaning substantially flat articles, which includes wire bristle rollers for cleaning baking pans transferred on a conveyor. Also, U.S. Pat. No 1,930,575, granted to Wynd et al., discloses a sheet drying apparatus, which includes infeed rollers, washer spray pipes, brush rollers, outfeed rollers, and a pressurized air nozzle assembly, which are all used in conjunction for drying sheets of material, such as the glass and celluloid used in the manufacture of laminated glass.

However, there are a few apparatuses that teach cleaning flexible mats, but the apparatus only cleans one side of the mat. For instance, U.S. Pat. No. 3,396,422, granted to Haverberg, discloses a machine which washes and dries automobile floor mats. Infeed rollers are provided for feeding a floor mat to the rotary brushes. Outfeed rollers impart a squeezing action to the floor mat when fed therebetween, and a fan is provided for blowing air over the floor mat for the drying thereof. Further, U.S. Pat. No. 4,926,520, granted to Watson, describes a method and apparatus for cleaning carpet tiles.

Infeed rollers are provided for continuously propelling a carpet tile over a nozzle bank that subjects the pile side of the carpet tile to a cleaning fluid spray. A scrubbing roller then scrubs the pile side of the carpet tile, and the carpet tile is next propelled over rinsing nozzles that rinse the cleaning fluid therefrom. After passing over the rinsing nozzles, the carpet tile is propelled from the cleaning compartment and to the unloading station by outfeed rollers that squeeze excess fluid from the carpet tile and also move the carpet tile over a vacuum slot, which vacuums residual fluid therefrom.

U.S. Pat. No. 5,072,478, granted to Wagner et al., teaches cleaning both sides of a semi-rigid item. Wagner describes a mobile vertical blinds cleaning machine for cleaning both surfaces of individual blinds panels of all types including plastic blinds, fabric covered blinds, and fabric blinds. It uses an elongated tank divided into separate liquid tight solution cleaning, rinse, and drying chambers, with a pair of feed rolls located at the entrance end of each of the chambers and the exit end of the drying chamber. Wagner, however, requires that the blinds be fed through a bath of solution, that the blinds be rinsed with water via nozzles, and that the blinds are blown-dry with forced air convection.

There is a machine available for sale called "The Big Squeeze Ultimate Model U-1 Floor Mat Cleaner" by J-Ko Company, which is advertised to "clean carpet and rubber floor mats" with the aid of water, chemical, and high speed nylon brushes. It is advertised for use on automobile floor mats. It uses extraction, vacuums, hot air, and rollers to dry the mats. It is very large, uses a lot of power, and requires a garden hose hook-up. The J-Ko machine would not be appropriate for use in an exercise studio or health club because of how large it is, how much power it uses, and how much water it uses.

There is another product available for sale called "Matsana". It is advertised to "sanitize" yoga mats using ultraviolet light, only. No cleaning solution is used, however, so the machine does not clean debris from the mat.

Of the above prior art or products found for sale, none are particularly adapted for applying solution, cleaning, and removing said solution from both sides of thin, flexible mats used for yoga, pilates, barre, or other similar exercises, or for use in an gym, exercise studio, or health club. Accordingly, there is a long felt need in the art for an apparatus that cleans both sides of thin, flexible, and uncarpeted floor mats, such as those used for yoga, pilates, or barre, that does not use a lot of power, does not use a lot of water, or does not take up very much floor space.

BRIEF SUMMARY OF THE INVENTION

The present invention discloses a mat cleaning machine, and a method for cleaning the mat.

The present invention recognizes a need that the prior art does not fill. Thus, it is a general object of the present invention to provide a machine that cleans both sides of a rubberized, plastic, or foam exercise mat.

Still another object of the present invention is to provide a method for cleaning a rubberized, plastic, or foam exercise mat.

Yet another object of the present invention is to provide a mat cleaning machine that is lightweight enough so that it can be carried and moved easily in an indoor space.

Various combinations of presently disclosed features may be provided in a given embodiment thereof, in accordance with this invention. Generally, one such exemplary embodiment of the present invention includes an exercise mat cleaning machine comprising: a frame structure, infeed rollers, an infeed roller solution reservoir, secondary solution applicator rollers, a secondary solution applicator reservoir, scrubbing rollers, outfeed rollers, solution removal blades, a solution collection reservoir, mat guides, a mechanism to synchronize the rollers, and a housing.

A pair of infeed rollers is connected to the frame structure and consists of counter-rotating rollers comprised at least partially of high friction material and is particularly adapted for grabbing different types of exercise mats that a user delivers to the loading station. A pair of outfeed rollers is connected to the frame structure and consists of counter-rotating rollers that remove excess solution from the mat. Solution is applied via the infeed rollers and the secondary solution applicator rollers, also connected to the frame, and are situated in such a way as to apply solution to both sides of the mat after the mat travels through the infeed rollers and secondary rollers but before the mat reaches the scrubbing rollers. The infeed rollers and secondary rollers are at least partially bathed in solution and transport solution from the reservoirs to the mat. Scrubbing rollers are connected to the frame structure between the secondary rollers and outfeed rollers and are adapted to simultaneously scrub both sides of an exercise mat.

The present invention also includes a method of cleaning both sides of an exercise mat. The method comprises infeeding a mat with rollers into an exercise mat cleaning compartment of an exercise mat cleaning machine, applying solution to both sides of the exercise mat with solution applicator rollers in the exercise mat cleaning compartment of the exercise mat cleaning machine, both sides of the exercise mat being wetted with a cleaning solution by the solution applicator rollers. The method further includes scrubbing both sides of the exercise mat in the exercise mat cleaning compartment of the exercise mat cleaning machine with scrubbing brushes or bristles after wetting both sides of the exercise mat by the cleaning solution of the solution applicator. After scrubbing, the method includes removing the excess fluid from both sides of the exercise mat using outfeed rollers and solution removal blades in the exercise mat cleaning compartment of the exercise mat cleaning machine.

BRIEF DESCRIPTION OF THE DRAWINGS

The invention can be better understood with reference to the following drawings. Those of skill in the art will understand that the drawings, described below, are for illustrative purposes only. The drawings are not intended to limit the scope of the present teachings in any way. The drawings disclose illustrative embodiments. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it is intended to refer to the same or like components or steps.

DETAILED DESCRIPTION OF THE INVENTION

In the following detailed description of various exemplary embodiments, reference is made to the accompanying drawings that form a part hereof, and in which is shown, by way of illustration, a specific embodiments that may be practiced. It is to be understood that other embodiments may be utilized and structural changes may be made without departing from the scope of the present disclosure.

Figure 1:
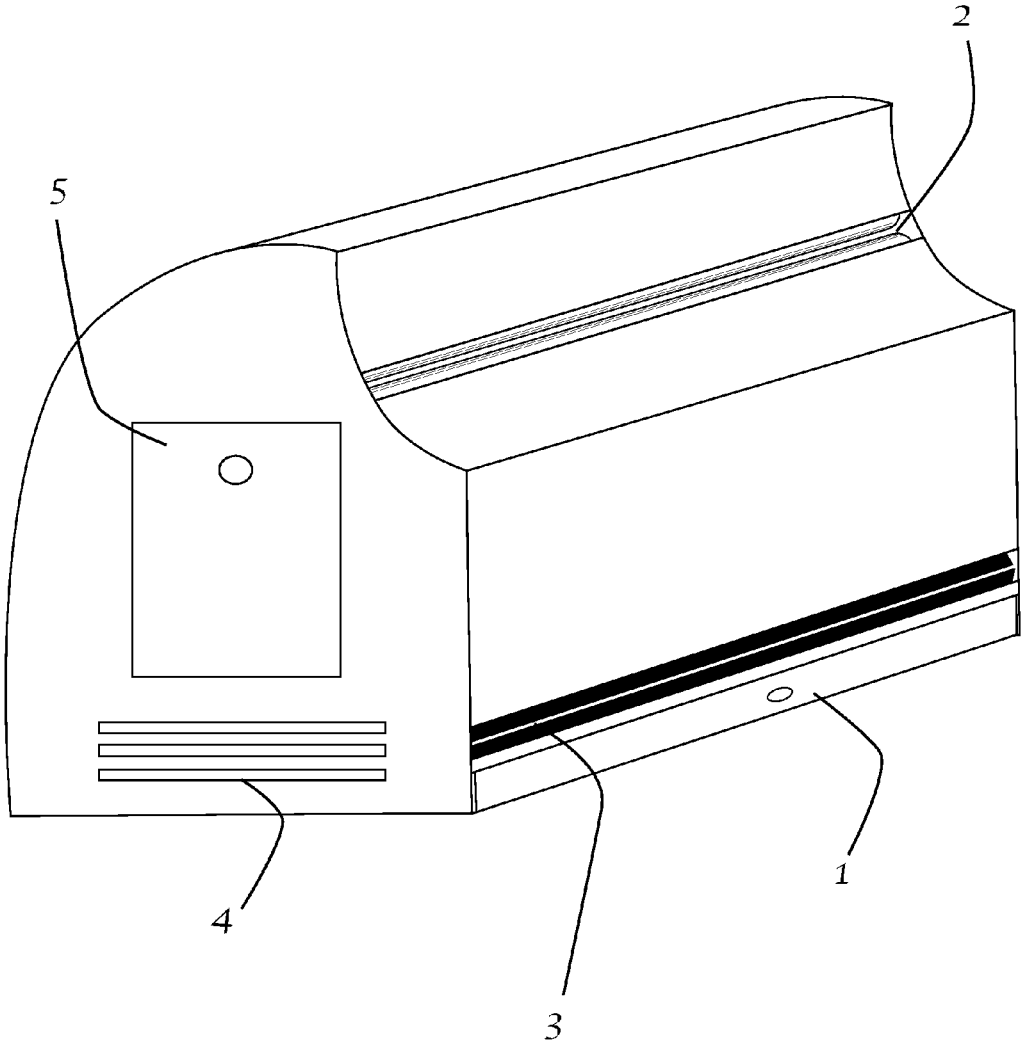
FIG. 1 is an illustration of one embodiment of the outside of the machine.

FIG. 1 is an illustration of one embodiment of the outside of the machine and shows the general shape and construction. FIG. 1 shows the front panel 1 of the solution collection reservoir 12 is located at the bottom of the machine. This position is beneficial because gravity channels used solution and debris removed from the mat to the solution collection reservoir 12. The solution collection reservoir 12 can easily be removed in a drawer-like fashion to facilitate emptying the reservoir's contents.

FIG. 1 also shows the inlet of the machine, where the user inserts the mat between the counter-rotating infeed rollers 2. The counter-rotation is helpful so the machine can continue to feed the mat into itself after the user delivers the first portion of the unclean mat to the first opening of the machine.

FIG. 1 also shows solution removal blades 3 to maximize dryness of the mat when returned to the user. In a preferred embodiment, the solution removal blades 3 may be made of a low durometer elastomer, such as silicone rubber, to conform to the various surface textures of the different styles and compositions of exercise mats.

FIG. 1 also shows slotted vents 4 to facilitate airflow through the machine.

FIG. 1 also shows an access door 5 for filling the solution reservoirs and/or unclogging a jammed mechanism, if necessary.

Figure 2:
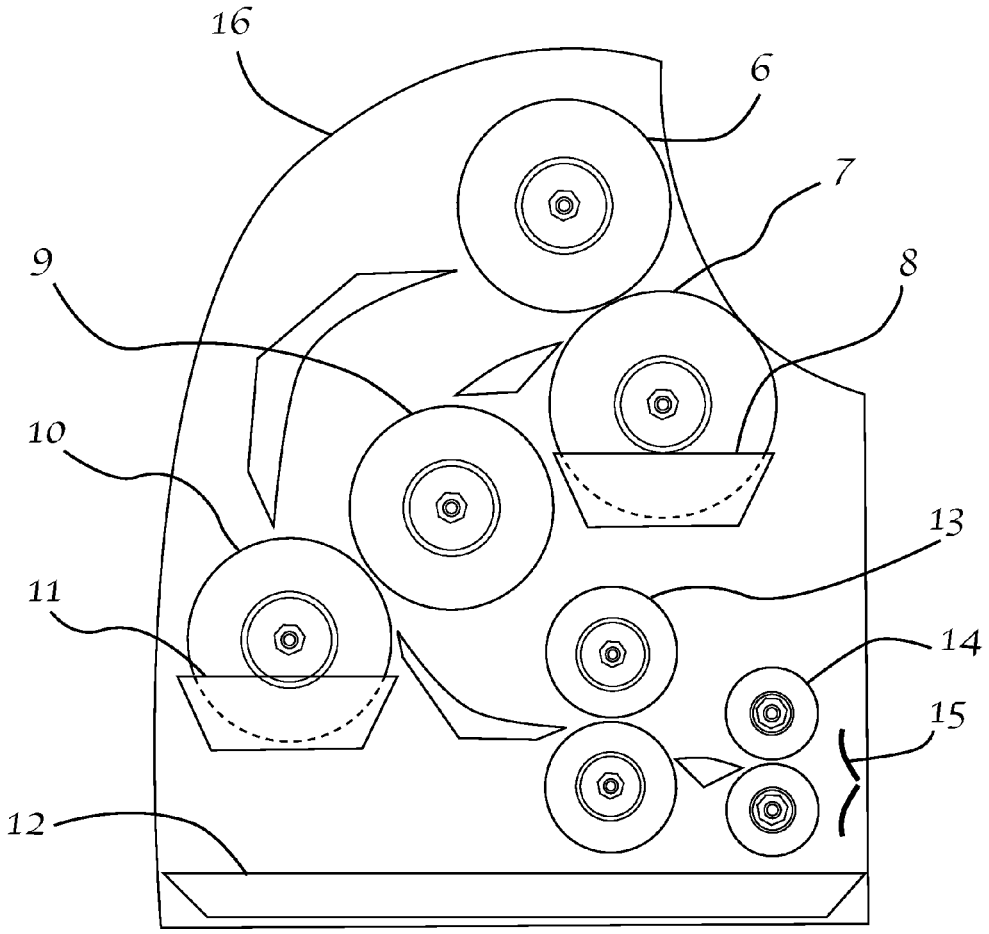
FIG. 2 is an illustration of one embodiment of the machine to show an internal cross-section.

FIG. 2 is an illustration of one embodiment of the machine to show an internal cross-section. In a preferred embodiment, the top infeed roller 6 and bottom infeed roller 7 may be comprised of a high friction material, such as rubber, to pull the mat into the machine. The bottom infeed roller 7 may have a surface pattern or texture incorporated into the high friction material in order to scoop and transport the solution from the infeed roller solution reservoir 8 to the bottom side of the mat.

FIG. 2 also shows the top secondary solution applicator roller 9 and the bottom secondary solution applicator roller 10. In a preferred embodiment, the bottom secondary solution applicator roller 10 may have a surface pattern or texture incorporated into the high friction material in order to scoop and transport the solution from the secondary roller solution reservoir 11 to the top side of the mat. The secondary solution applicator rollers also counter-rotate to pull the mat through the machine.

FIG. 2 also shows the scrubbing rollers 13. In a preferred embodiment, the scrubbing rollers have bristles made of nylon or some other similar robust, flexible plastic. The bristles of the scrubbing rollers 13 may extend radially outward from the center of the roller, but then may be positioned in spiral rows that traverse the axis of the roller. As the scrubbing rollers 13 rotate about their axes, the spiral configuration of the bristles pulls debris away from the longitudinal centerline of the mat toward the outside edge of the mat.

FIG. 2 also shows the outfeed rollers 14 that are positioned closely together so as to squeeze much of the solution from the mat prior to engaging the solution removal blades 15. As the mat passes through the solution removal blades 15, the excess solution drains into the solution collection reservoir 12.

FIG. 2 also shows the housing 16 that encloses the entire machine.

Figure 3:
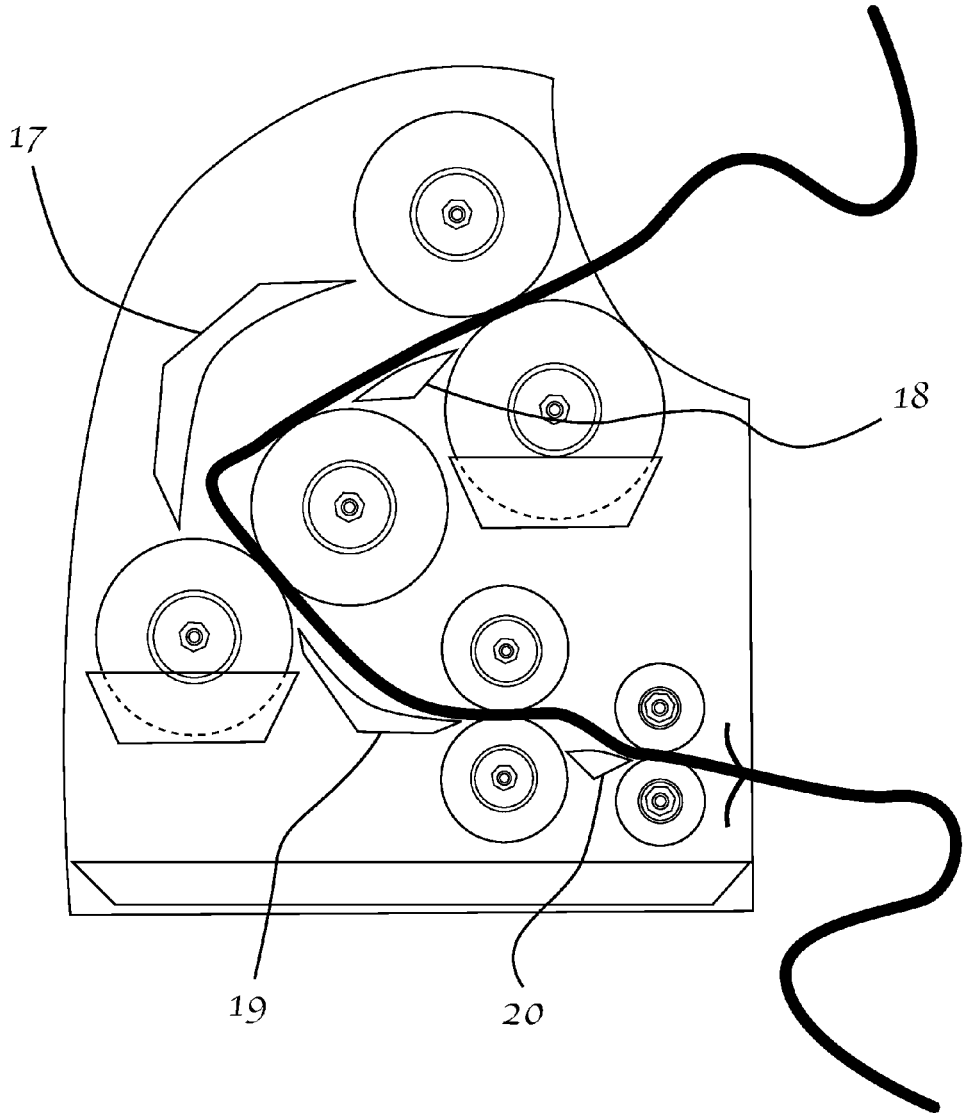
FIG. 3 is an illustration of one embodiment of the machine to show another internal cross-section and the route an exercise mat travels through the machine.

FIG. 3 is an illustration of one embodiment of the machine to show another internal cross-section and the route an exercise mat travels through the machine. The inlet mat guide 18 ensures that the mat travels in the proper direction to the top secondary solution applicator roller 9. Some mats might possibly jam in the machine without the inlet mat guide 18.

FIG. 3 also shows a mat guide 17 that redirects the mat to pass through the secondary solution applicator rollers 9 and 10.

FIG. 3 also shows a mat guide 19 that redirects the mat to pass through the scrubbing rollers 13.

FIG. 3 also shows a mat guide 20 that ensures the mat travels to the outfeed rollers 14.

Figure 4:
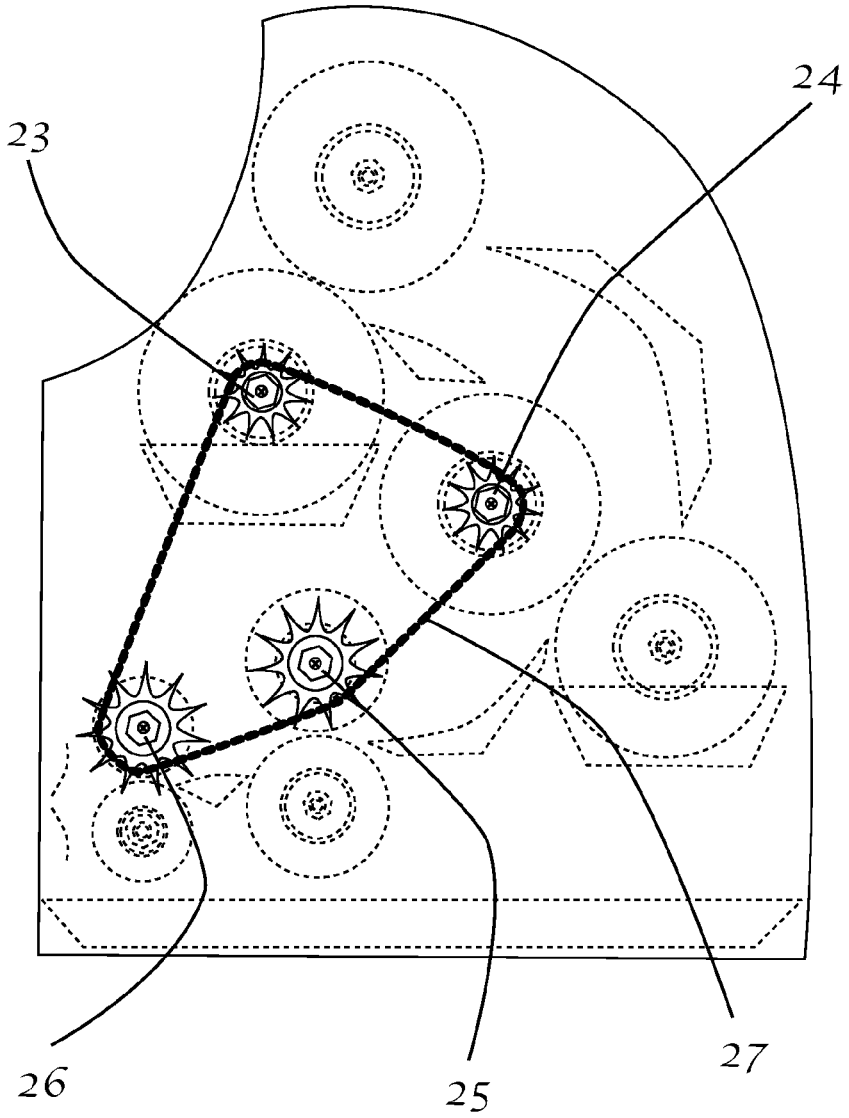
FIG. 4 is an illustration of one embodiment of the machine to show the mechanism used to synchronize all of the rollers.

FIG. 4 is an illustration of one embodiment of the machine to show the mechanism used to synchronize all of the rollers. An inlet roller gear 23, secondary roller gear 24, scrubber roller gear 25, and outlet roller gear 26 are synchronously linked to one another by a chain 27. The scrubber roller gear 25 is sized differently from the other gears to increase rotational speed.

Figure 5:
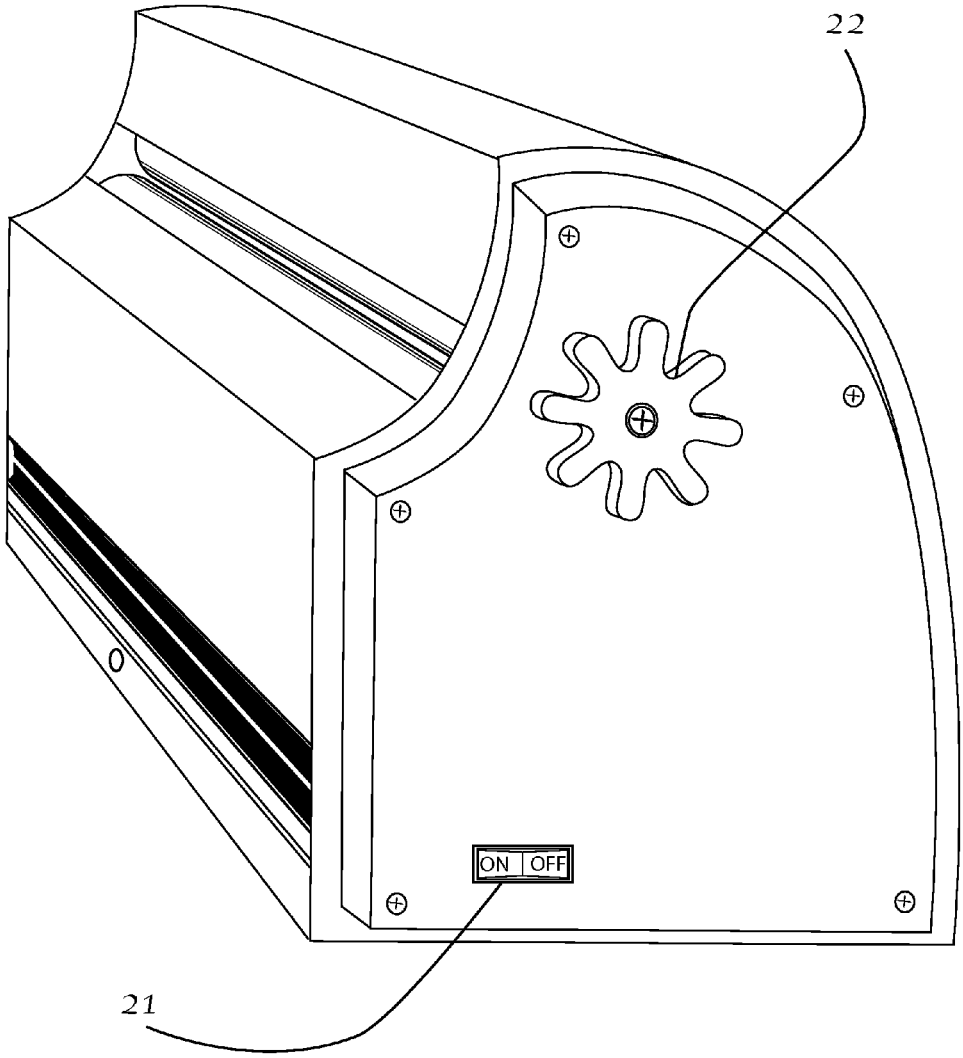
FIG. 5 is an illustration of one embodiment of the machine to show one possible means with which to move the mat though the machine.

FIG. 5 is an illustration of one embodiment of the machine to show one possible means with which to move the mat though the machine. A power switch 21 can initiate an electric motor to move the mechanism that synchronously drives the gears shown in FIG. 4 and pull the mat through the machine. A hand crank 22 is provided in an alternate embodiment to operate the machine without electric power or to remove a mat from a clogged or broken down machine.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims.

What is claim is:

1. An exercise mat cleaning machine, comprising:

a frame structure;

infeed rollers adapted to receive an exercise mat, comprising a top infeed roller and a bottom infeed roller rotatably coupled to the frame structure;

an infeed roller solution applicator reservoir affixed to the frame structure, wherein the bottom infeed roller is adapted to transport solution from the infeed roller solution reservoir to a first side of an exercise mat;

secondary solution applicator rollers adapted to receive an exercise mat from the infeed rollers, comprising a top secondary solution applicator roller and a bottom secondary solution applicator roller rotatably coupled to the frame structure;

a secondary solution applicator reservoir affixed to the frame structure, wherein the bottom secondary application solution roller is adapted to transport solution from the secondary solution applicator reservoir to a second side of an exercise mat;

scrubbing rollers rotatably coupled to the frame structure;

outfeed rollers rotatably coupled to the frame structure;

solution removal blades affixed to the frame structure;

a solution collection reservoir affixed to the frame structure and located at the bottommost portion of the frame structure;

mat guides affixed to the frame structure;

a mechanism to synchronize and couple the rollers; and a housing enclosing the frame structure and affixed thereto.

2. The exercise mat cleaning machine of claim 1, wherein the frame structure further comprises pivot points for each end of each roller.

3. The exercise mat cleaning machine of claim 1, wherein the infeed rollers comprise:

a high friction material to pull an exercise mat into the machine;

a surface pattern adapted to gather and transport solution from the infeed roller solution applicator reservoir to the exercise mat; and a gear on an end of each roller interlinks to create counter-rotation between the infeed rollers.

4. The exercise mat cleaning machine of claim 1, wherein the infeed solution applicator reservoir is adapted to accommodate the entire length of the infeed rollers and at least partially bathe the bottom infeed roller in solution.

5. The exercise mat cleaning machine of claim 1, wherein the secondary solution applicator rollers comprise:

a high friction material to pull the mat from the infeed rollers;

a surface pattern adapted to gather and transport solution from the secondary solution applicator reservoir to the mat; and a gear on an end of each roller interlinks to create counter-rotation between the rollers.

6. The exercise mat cleaning machine of claim 1, wherein the secondary solution applicator reservoir is adapted to accommodate the entire length of the secondary solution applicator rollers and at least partially bathe the bottom secondary solution applicator roller in solution.

7. The exercise mat cleaning machine of claim 1, wherein the scrubbing rollers comprise:

spiral bristles adapted to laterally remove debris from the exercise mat; and a gear on an end of each roller interlinks to create counter-rotation between the rollers.

8. The exercise mat cleaning machine of claim 1, wherein the mechanism to synchronize and couple the rollers is a chain.

9. The exercise mat cleaning machine of claim 1, wherein the outfeed rollers comprise:

a high friction material to pull the exercise mat from the scrubbing rollers; and a gear on an end of each roller interlinks to create counter-rotation between the rollers.

10. The exercise mat cleaning machine of claim 1, wherein a spacing between the outfeed rollers is adapted to remove excess solution by squeezing the exercise mat.

11. The exercise mat cleaning machine of claim 1, wherein the solution removal blades comprise a soft material that conforms to the exercise mat's surface texture to remove excess solution from the exercise mat.

12. The exercise mat cleaning machine of claim 1, wherein the solution collection reservoir is positioned at the bottom of machine.

13. The exercise mat cleaning machine of claim 1, wherein the solution collection reservoir is adapted to slide out of the machine to facilitate removal of used solution.

14. The exercise mat cleaning machine of claim 1, wherein the mat guides properly route the exercise mat through the machine.

15. The exercise mat cleaning machine of claim 1, wherein the mechanism synchronizes the infeed rollers, secondary solution applicator rollers, and outfeed rollers at the same rotational speed.

16. The exercise mat cleaning machine of claim 1, wherein the mechanism rotates the scrubbing rollers at a higher speed than the infeed rollers, secondary solution applicator rollers, and outfeed rollers.

17. The exercise mat cleaning machine of claim 1, wherein the mechanism is driven by an electric motor.

18. The exercise mat cleaning machine of claim 1, wherein the mechanism is driven by a hand crank.

* * * * *